US006098361A

United States Patent [19]

Roten et al.

[11] Patent Number: 6,098,361

[45] Date of Patent: Aug. 8, 2000

[54] PARKING METER ANCHOR SYSTEM

[75] Inventors: J. Michael Roten; William C. Kiehl, both of Russellville; Seth Ward, II, Little Rock, all of Ark.

[73] Assignee: POM, Inc., Russellville, Ark.

[21] Appl. No.: 09/038,218

[22] Filed: Mar. 11, 1998

Related U.S. Application Data

[63] Continuation of application No. PCT/US97/07546, Apr. 16, 1997.

[60] Provisional application No. 60/016,334, Apr. 24, 1996, and provisional application No. 60/036,888, Feb. 5, 1997.

[51] Int. Cl.[7] ..... E02D 5/80

[52] U.S. Cl. ..... 52/298; 403/277; 403/279

[58] Field of Search ..... 52/298; 403/277, 403/279, 281, 274

[56] References Cited

U.S. PATENT DOCUMENTS

| | | | |
|---|---|---|---|
| 160,574 | 3/1875 | Cornell | 52/298 |
| 680,342 | 8/1901 | Martin | 52/298 |
| 1,991,087 | 2/1935 | Falcon . | |
| 2,859,840 | 11/1958 | Fantle | 52/298 X |
| 2,950,132 | 8/1960 | Kocsuta | 403/281 X |
| 3,267,627 | 8/1966 | Hammitt | 52/298 |
| 3,349,531 | 10/1967 | Watson | 52/296 |
| 3,462,126 | 8/1969 | Demanega . | |
| 3,471,129 | 10/1969 | Mpakarakes . | |
| 3,667,405 | 6/1972 | Roach, Jr. . | |
| 4,120,125 | 10/1978 | Cvetan | 52/298 X |
| 4,124,959 | 11/1978 | Hill | 52/298 |
| 4,553,358 | 11/1985 | Deike | 52/298 X |

*Primary Examiner*—Carl D. Friedman
*Assistant Examiner*—Phi Dieu Tran A
*Attorney, Agent, or Firm*—Robert Groover; Betty Formby

[57] ABSTRACT

A post attachment including an anchor receptacle (20) mounted in the ground. A post (30) is attached to the anchor receptacle by a removable locking bar (40) which engages a slot (34) in the post and a groove (28) in the anchor receptacle. A first tool (12) is utilized which straightens the locking bar for attachment of the post to the anchor receptacle. A second tool (14) is utilized which bends the locking bar for disengagement from the post slot and anchor receptacle groove so that the post may be removed from the anchor receptacle.

18 Claims, 3 Drawing Sheets

PARKING METER ANCHOR SYSTEM

This application is claiming priority of the continuation of PCT/US97/07546 filed Apr. 16, 1997, Provisional applications 60/016334 filed Apr. 24, 1996, and 60/036888 filed Feb. 5, 1997.

BACKGROUND AND SUMMARY OF THE INVENTION

The present invention relates to the physical attachment of parking meters to the ground.

A basic challenge with parking meters is that they are necessarily located in very exposed locations, where they may be damaged by vandalism, theft, and impacts from automobile bumpers. A firm physical connection is therefore necessary. However, it is also necessary to be able to remove the post for replacement (e.g., after it is struck by a car). At the same time, changes in public policy may necessitate removal of parking meters from previous positions and reinstallation in a new location.

Traditionally, the posts used for mounting parking meters are hollow, round, made of galvanized steel or other heavy duty metal, and are set in concrete. Removal of such a post requires considerable labor to break down the concrete base and remove the post. To replace the post, the hole must then be cleared and refilled with concrete, and the post set and leveled.

The inventive anchoring system and method for installation provides a quick and easy method for removing and reinstalling posts without destroying the foundation for the post. The system includes a generally cylindrical anchor receptacle which is installed in the ground so that its top surface is approximately flush with the surrounding surface. In the presently preferred embodiment, the anchor receptacle includes a groove cut into its inner circumference. A post fits inside the anchor receptacle and has a slot going through the post that may be aligned with the groove in the anchor receptacle. A locking bar that may be inserted through the slot in the post and into the groove of the anchor receptacle completes the system. The locking bar is inserted into the post slot in a bent form, with the bend up; once the end of the post has been inserted into the anchor receptacle, an installation tool flattens the bent locking bar inside the post, so that it engages the groove in the anchor receptacle, and completes installation. Pressure from the insertion of a removal tool re-bends the locking bar in the other direction, allowing quick removal of the post.

The advantages of the inventive system and method include at least the following:

- the installation is both sturdy, for long-term use, and removable, for ease of replacement;
- the cost of replacing posts is greatly reduced;
- the time needed to replace posts is reduced;
- all parts are easily and cheaply made;
- the locking mechanism is not easily reachable by vandals.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Figure 2A:
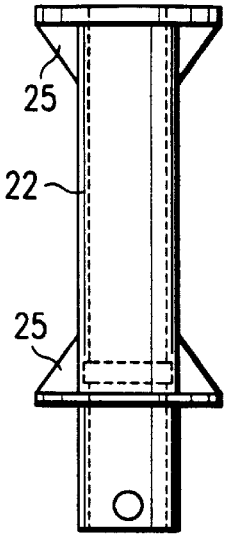
FIGS. 2A–2C show the post anchor receptacle, giving external, cross-sectional and top views.
Figure 2B:
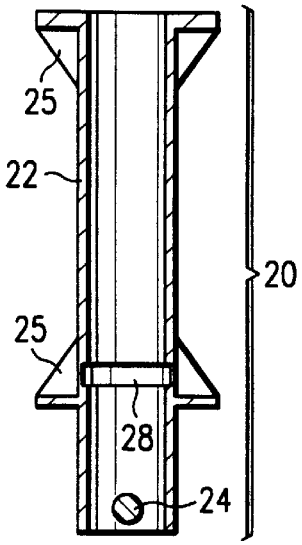
Figure 2C:
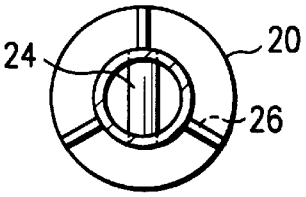

FIGS. 2A–2C show the presently preferred embodiment of the anchor receptacle of the inventive system showing respectively an external, cross-sectional, and top view of the post. The anchor receptacle socket 20 has a preferably cylindrical body 22 made of 5/32" thick galvanized steel cylindrical tubing having an outside diameter of 2.75–. A positioning bar 24, having a ¾" diameter, crosses a diameter of the anchor receptacle, approximately 1¼" above the bottom.

Two cone-shaped collars 25 encircle the anchor receptacle, at the top of the body and near the bottom, to prevent the receptacle from being pulled out of the concrete. In the presently preferred embodiment, three fins 26 project outward from the body of the anchor receptacle to each collar. These prevent the anchor receptacle from turning in the hardened concrete and to provide support to the collar. On the inner surface of the anchor receptacle, a groove 28 approximately 0.015" deep and 7/16" wide extends around the inner circumference of the body in the presently preferred embodiment.

Figures 3A, 3B:
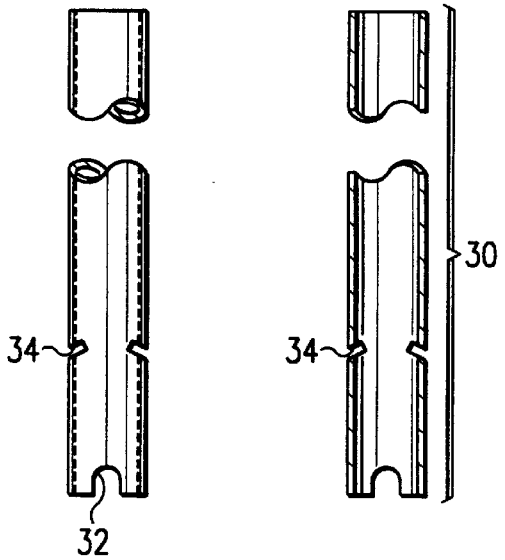
FIGS. 3A–3C show the post, giving external, cross-sectional and top views.
Figure 3C:
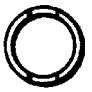

FIGS. 3A–3C show the post of the presently preferred embodiment, giving an external, cross-sectional and top view. The post 30 is preferably a 2-inch schedule 40 steel pipe, although it may be heavier, such as schedule 80 pipe. When the post is inserted into the anchor receptacle, a roughly semi-circular cutout 32 on the bottommost edge of the post fits over the positioning bar 24 to correctly align the post to the anchor receptacle. At the same time slots 34 through the walls of the post are aligned with groove 28 of the anchor receptacle.

Figure 4A:
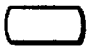
FIGS. 4A–4C show the locking bar giving top, side (before bending) and side (after bending) views.
Figure 4B:
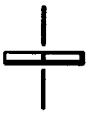
Figure 4C:
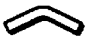

FIGS. 4A–4C show the locking bar 40. This piece is machined or stamped from a piece of flat metal, preferably 3/16" cold rolled galvanized steel. In the preferred embodiment, this piece is 1" wide, with rounded ends that match the inside diameter of the body of the anchor receptacle. The locking bar is bent, as shown in 4C, to allow insertion of the post and locking bar into the anchor receptacle.

Figures 1A, 1B, 1C, 1D, 1E, 1F, 1G:
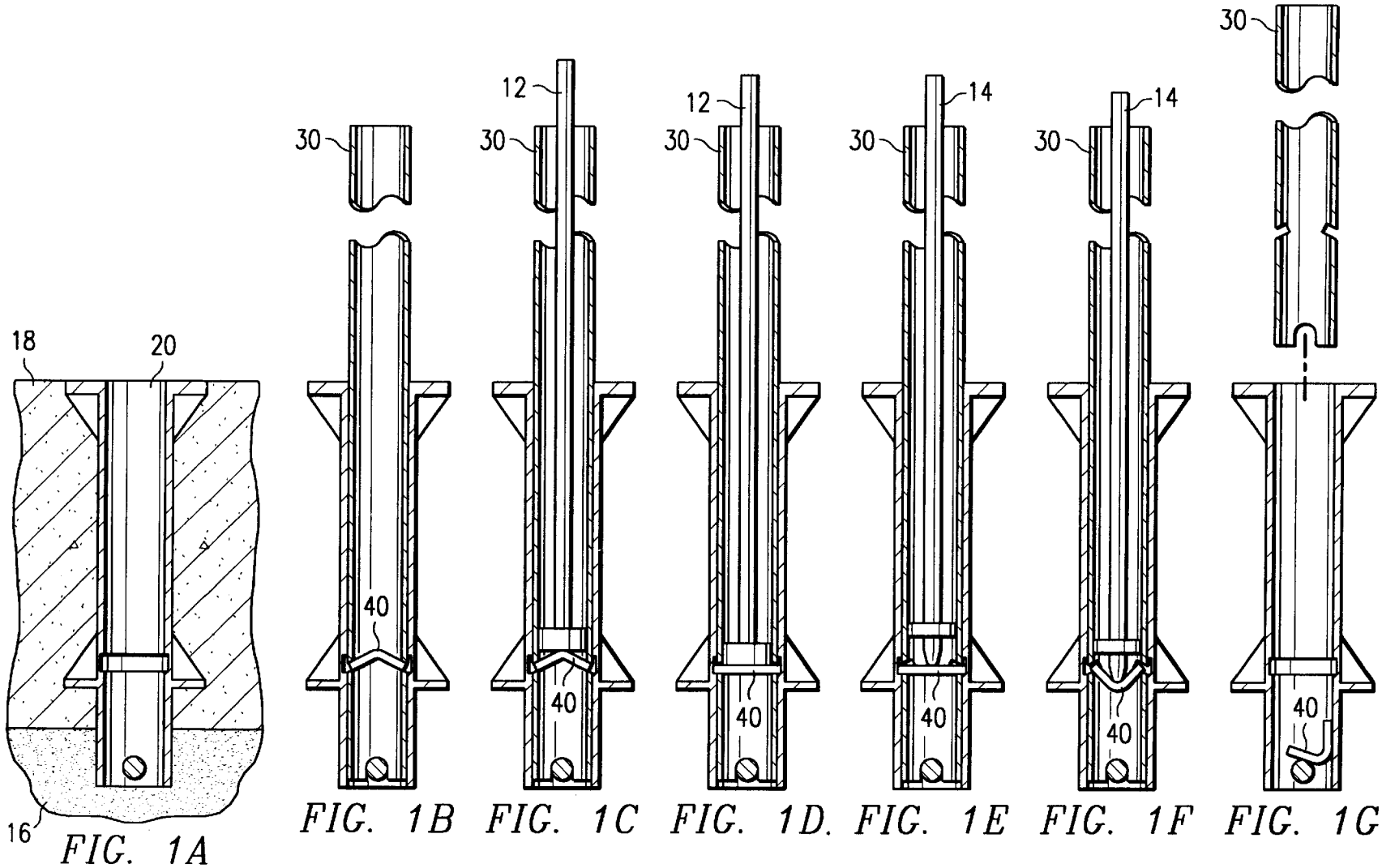
FIGS. 1A through 1G show installation and subsequent removal of an in-ground parking meter anchor and post.

As shown in FIG. 1A, the anchor receptacle 20 is first set in a hole that has loose, coarse gravel 16 in the bottom, then quick setting concrete 18 is poured around the anchor to fill the hole. A temporary post may be installed at this time to level the anchor receptacle in the concrete. Excess concrete is cleaned from around the top hole of the anchor receptacle so that it is flush with the surrounding ground surface.

FIGS. 1B–1D show the installation of a post. A bent locking bar 40 is placed inside the post 30. This can easily be done in the field, by inserting the locking bar through one side of the slot in the post until both ends are engaged. A piece of tape will hold the locking bar in place while the post is inserted in the receptacle. Cutout 32 fits snugly over the positioning bar 24 and automatically aligns slot 34 and groove 28. Tool 12, having a substantially flat lower surface, is then inserted into the post to flatten locking bar 10, so that it reaches through slot 34 in the post to engage groove 28 in the anchor receptacle. The tool (12) will typically weigh 10–15 pounds, and acts simply as a hammer on a stick. This secures the post and anchor receptacle together in a semi-permanent attachment.

Removal of the post from the anchor receptacle is shown in FIGS. 1E–1G. First, instrument 14, which has an extension which is self-aligned to the center of the post, is inserted into the post as shown in 1E. Downward pressure on instrument 14 causes locking bar 10 to bend in the opposite direction as it was previously bent. This will cause the locking bar to disengage from groove 28, and optionally from slot 34, leaving the post and anchor receptacle once again easily separable.

Figure 5:
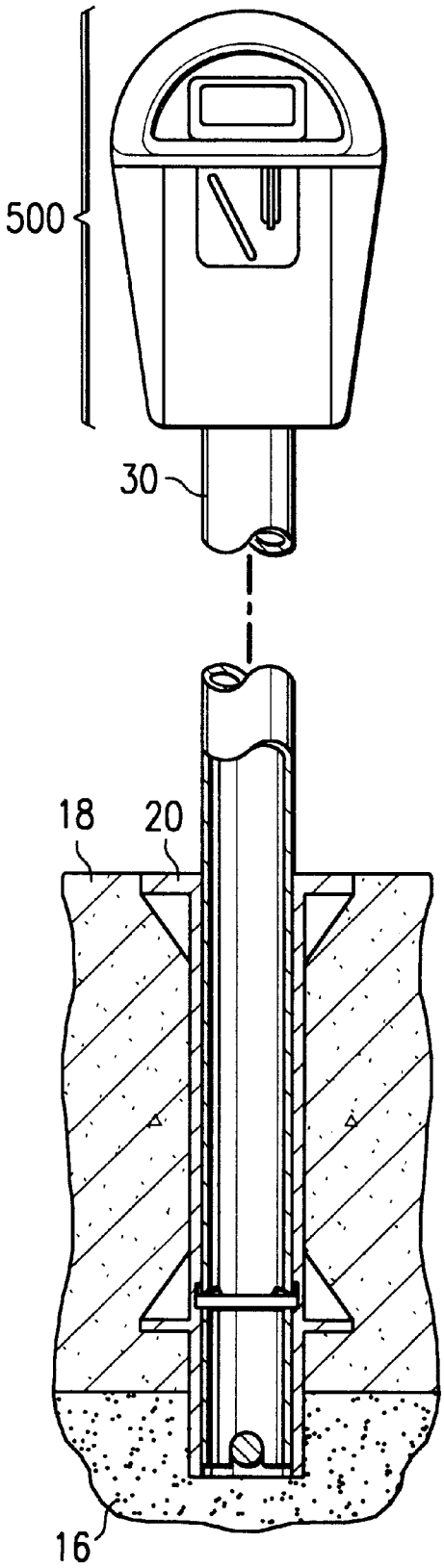
FIG. 5 shows a cross-section of the post, complete with an installed parking meter.

FIG. 5 shows the post (30) and anchor receptacle (20), complete with an installed parking meter (500), with the post and anchor receptacle being shown in cross-section.

Figure 6:
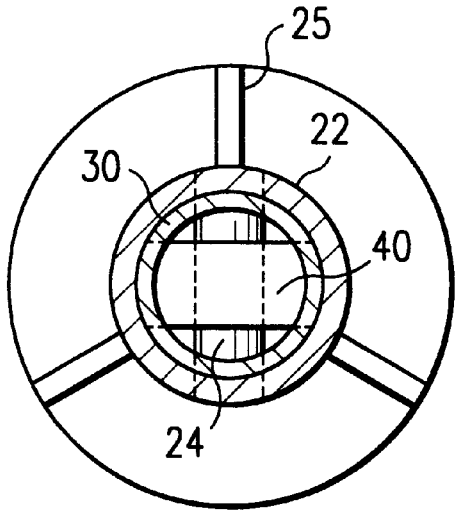
FIG. 6 shows a top view through the post once the locking bar has been installed.

FIG. 6 shows a top view through the post once the locking bar has been installed.

According to a disclosed class of innovative embodiments, there is provided: A mounting system for a parking meter, comprising: an anchor receptacle designed to be permanently attached to the ground; a post, one end of which fits inside said anchor receptacle; a locking bar which is designed to be inserted into said post to lock said post and said anchor receptacle together in a fixed position; a first tool which straightens said locking bar from a bent position to attach said anchor receptacle to said post; a second tool which bends said locking bar to disconnect said anchor receptacle from said post.

According to a disclosed class of innovative embodiments, there is provided: A parking meter, comprising: an anchor receptacle which is permanently attached to the ground; a post, a first end of which is inserted into said anchor receptacle; a meter, attached to a second end of said post, for the receipt of payment of parking fees; a locking bar which extends through one or more apertures in said post to engage an inner surface of said anchor receptacle.

According to a disclosed class of innovative embodiments, there is provided: A mounting structure, comprising: an anchor receptacle comprising a first hollow tube; a post comprising a second hollow tube, a first end of which is inserted into said second end of said anchor receptacle, said post having an aperture in a surface thereof; a locking bar of a deformable material; wherein a portion of said locking bar is forced through said aperture to engage an inner surface of said anchor receptacle and thereby removeably hold said anchor receptacle and said post in a fixed relationship.

According to a disclosed class of innovative embodiments, there is provided: A method for providing support for a parking meter, comprising the steps of: a) permanently mounting an anchor receptacle to the ground; b) aligning a bent locking bar with apertures in a post; c) inserting a first end of said post containing said locking bar into said anchor receptacle; d) using a first tool to straighten said locking bar, thereby engaging said anchor receptacle to lock said post to said anchor receptacle in a fixed relationship; e) attaching a parking meter to said post; e) when it becomes desirable to remove or replace said post, using a second tool to bend said locking bar and at least partially disengage from said anchor receptacle, thereby allowing said post to be removed from said anchor receptacle.

According to a disclosed class of innovative embodiments, there is provided: A method of installing a mounting post, comprising the steps of: a) permanently mounting an anchor receptacle to the ground; b) inserting a bent locking bar into said post to engage an aperture in said post; c) inserting a first end of said post containing said locking bar into said anchor receptacle; d) using a tool to straighten said locking bar, thereby locking said post to said anchor receptacle in a fixed relationship.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

This method is equally applicable to mounting signs and other utility items. It would also be useful for fencing where various perimeter locations are required for multi-purpose activities.

Other styles of anchor receptacle could be used. The body, for example, could have a square or rectangular cross-section, or it could be made from different materials.

The parts are generally made of galvanized steel, but could also be made of stainless steel.

The groove on the—inside of the anchor receptacle is not strictly necessary. It could be reduced to several dimples on the inside of the receptacle or even left entirely off to that the locking bar is simply jammed against the inside of the anchor receptacle.

A different configuration than the positioning cross-bar/cutout could be used to provide vertical and rotational positioning of the post within the anchor receptacle, i.e., a special tool could hold the post in the proper relationship while the locking bar is locked into position.

What is claimed is:

1. A mounting system for a parking meter, comprising:

an anchor receptacle designed to be permanently attached to the ground;

a post, one end of which fits inside said anchor receptacle;

a locking bar which is designed to be inserted into said post to lock said post and said anchor receptacle together in a fixed position;

a first tool which straightens said locking bar from a bent position to attach said anchor receptacle to said post;

a second tool which bends said locking bar to disconnect said anchor receptacle from said post.

2. The mounting system of claim 1, wherein said anchor receptacle comprises a hollow tube having a groove on an inner circumference thereof.

3. The mounting system of claim 1, wherein said post comprises a hollow tube having an aperture through the walls thereof.

4. The mounting system of claim 1, wherein said first tool causes a portion of said locking bar to be pushed through an aperture in said post to engage a groove in said anchor receptacle.

5. The mounting system of claim 1, wherein said second tool causes said locking bar to be bent, wherein said post and said anchor receptacle are no longer locked in said fixed relationship.

6. A parking meter, comprising:

an anchor receptacle which is permanently attached to the ground;

a post, a first end of which is inserted into said anchor receptacle;

a meter, attached to a second end of said post, for the receipt of payment of parking fees;

a deformable locking bar which extends through one or more apertures in said post to engage an inner surface of said anchor receptacle;

wherein bending said locking bar allows said locking bar to disengage from said inner surface of said anchor receptacle, whereby said post may be removed from said anchor receptacle.

7. The parking meter of claim 6, wherein said anchor receptacle is attached to the ground by concrete.

8. The parking meter of claim 6, wherein said meter is an electronic meter.

9. The parking meter of claim 6, wherein said locking bar is not accessible when said meter is attached to said post.

10. A method for providing support for a parking meter, comprising the steps of:

(a.) permanently mounting an anchor receptacle to the ground;

(b.) aligning a bent locking bar with apertures in a post;

(c.) inserting a first end of said post containing said locking bar into said anchor receptacle;

(d.) using a first tool to straighten said locking bar, thereby engaging said anchor receptacle to lock said post to said anchor receptacle in a fixed relationship;

(e.) attaching a parking meter to said post;

(f.) when it becomes desirable to remove or replace said post, using a second tool to bend said locking bar and at least partially disengage from said anchor receptacle, thereby allowing said post to be removed from said anchor receptacle.

11. The method of claim 10, wherein said anchor receptacle is mounted in concrete.

12. The method of claim 10, wherein said locking bar is a substantially flat piece of metal with only one bend.

13. The method of claim 10, wherein said anchor receptacle and said post each comprises a hollow tube.

14. The method of claim 10 wherein straightening said locking bar causes it to be engaged in a groove on an inner surface of said anchor receptacle.

15. A method of installing a mounting post, comprising the steps of:

(a.) permanently mounting an anchor receptacle to the ground;

(b.) inserting a bent locking bar into said post to engage an aperture in said post;

(c.) inserting a first end of said post containing said locking bar into said anchor receptacle;

(d.) using a tool to straighten said locking bar, thereby locking said post to said anchor receptacle in a fixed relationship.

16. The method of claim 15, wherein said anchor receptacle is mounted in concrete.

17. The method of claim 15, wherein said anchor receptacle and said post each comprises a hollow tube.

18. The method of claim 15, wherein straightening said locking bar causes it to be engaged in a groove on an inner surface of said anchor receptacle.

* * * * *